US010745161B2

(12) United States Patent
Notsch

(10) Patent No.: US 10,745,161 B2
(45) Date of Patent: Aug. 18, 2020

(54) RETURNABLE CRATE LOADER

(71) Applicant: Christopher Notsch, New Brighton, MN (US)

(72) Inventor: Christopher Notsch, New Brighton, MN (US)

(73) Assignee: Delkor Systems, Inc., St. Paul, MN (US)

( * ) Notice: Subject to any disclaimer, the term of this patent is extended or adjusted under 35 U.S.C. 154(b) by 217 days.

(21) Appl. No.: 15/851,800

(22) Filed: Dec. 22, 2017

(65) Prior Publication Data

US 2019/0193883 A1 Jun. 27, 2019

(51) Int. Cl.

| | |
|---|---|
| ***B65B 35/36*** | (2006.01) |
| ***B65B 43/52*** | (2006.01) |
| ***B65B 5/06*** | (2006.01) |
| ***B65B 43/46*** | (2006.01) |
| ***B65B 5/08*** | (2006.01) |
| ***B65B 39/00*** | (2006.01) |
| ***B65B 21/14*** | (2006.01) |

(52) U.S. Cl.

CPC ..... *B65B 35/36* (2013.01); *B65B 5/06* (2013.01); *B65B 5/08* (2013.01); *B65B 21/14* (2013.01); *B65B 39/007* (2013.01); *B65B 43/46* (2013.01); *B65B 43/52* (2013.01)

(58) Field of Classification Search

CPC .. B65B 5/06; B65B 5/068; B65B 5/08; B65B 21/14; B65B 21/18; B65B 39/00; B65B 39/007; B65B 39/02; B65B 39/12; B65B 43/46; B65B 43/52; B65B 43/59; B31B 50/003; B21D 1/08

USPC ..... 53/235, 244, 247, 249, 255, 257, 261

See application file for complete search history.

(56) References Cited

U.S. PATENT DOCUMENTS

| | | | | | |
|---|---|---|---|---|---|
| 1,754,616 | A * | 4/1930 | Earl | B21D 1/08 | 72/364 |
| 2,510,343 | A * | 6/1950 | Krause et al. | B65B 5/101 | 53/261 |
| 2,850,858 | A * | 9/1958 | Daly et al. | B65B 7/28 | 53/306 |
| 3,001,350 | A * | 9/1961 | Heblij | B65B 35/38 | 53/245 |
| 3,262,304 | A * | 7/1966 | Schultz | B21D 1/08 | 72/393 |
| 3,383,833 | A * | 5/1968 | Pearson | B65B 5/06 | 53/247 |
| 3,404,509 | A * | 10/1968 | Schaewe et al. | B65B 5/06 | 53/473 |

(Continued)

*Primary Examiner* — Stephen F. Gerrity

(74) *Attorney, Agent, or Firm* — Tysver Beck Evans

(57) ABSTRACT

A system, apparatus and method are presented for loading product containers into a crate wherein the crate is a reusable crate having four sides, which may be distorted bowed or bent relative to a nominal position. The system has a conveyer to convey the crate to an actuation assembly. The actuation assembly then actuates the crate into contact with a bracing assembly. The bracing assembly has four bracing members, each of which has at least one bracing block engaged thereto. Each bracing block has a grasping portion which contacts and bias against one of the four sides of the crate when the crate is actuated into engagement with the bracing assembly so as to reposition the sides of the crate to be in the nominal position.

8 Claims, 8 Drawing Sheets

(56) References Cited

U.S. PATENT DOCUMENTS 3,410,046 A * 11/1968 Johnson ..... B65B 5/065
53/496
3,528,542 A * 9/1970 Miller ..... H01M 2/0242
429/176
3,673,756 A * 7/1972 Prete et al. ..... B65B 5/06
53/496
3,928,942 A * 12/1975 Paddock et al. ..... B65B 25/046
53/247
3,974,627 A * 8/1976 Groschopp ..... B65B 39/02
53/261
4,138,836 A * 2/1979 Crowe et al. ..... B65B 5/06
414/924
4,385,482 A * 5/1983 Booth ..... B65B 43/56
53/240
4,386,491 A * 6/1983 Cramer et al. ..... B65B 25/046
193/15
4,459,791 A * 7/1984 Booth ..... B65B 7/28
53/290
4,800,706 A * 1/1989 Dorner ..... B65B 5/06
53/245
5,661,949 A * 9/1997 Blanc ..... B65B 25/046
53/154
7,107,742 B2 * 9/2006 Blanc ..... B65B 5/105
53/153

* cited by examiner

RETURNABLE CRATE LOADER

FIELD OF THE INVENTION

The present disclosure is directed to crate loading apparatus, system and method of operating same; which utilizes returnable packaging crates, such as dairy or "milk crates" for example, that may either be optimally shaped or may have a degree of side warping or bending, which would otherwise render the crate unsuitable for re-use or otherwise being loaded with product containers.

SUMMARY

Reusable crates such as those made of plastic, such as high density polyethylene and similar materials, are commonly used to hold, packaging and ship a variety of product containers. Commonly referred to as dairy crates or milk crates (an example of such a crate is described in U.S. Pat. No. 3,390,808 the entire contents of which is incorporated herein by reference), such crates are particularly useful in shipping and packaging other product containers, as the crates have sufficient strength and durability so as to allow them to be stacked and reused many times with a plethora of product containers as well as diverse packaging and shipping environments. Unfortunately, over time such crates are known to warp or bow (typically in an inward direction) on one or more sides of the crate adjacent to the primary crate opening (where products are loaded and unloaded). If the degree of warping becomes substantive, it is not uncommon for the warped crate to disrupt a packaging line when an automated loader, attempting to load product containers into the warped crate, impacts or otherwise is interfered with one or more of the warped surfaces of the crate. This may result in the packaging line being shut down while the warped crate is removed and replaced with a properly shaped crate and the spilled or damaged product containers that were being loaded are reset or replaced. Such instances are both time consuming and costly.

The present disclosure provides for an apparatus, system and method of loading a crate which not only avoids such inefficiency but also allows many warped crates to continue to be used despite their distorted side or sides, which would likely interfere with other loading apparatuses, systems and methods.

Embodiments of the loading apparatus, system and method of use described herein include bracing blocks mounted to a bracing frame which act to center and force open a warped crate when the warped crate is pushed into position against the bracing blocks by the apparatus. Where a crate is not warped the bracing block simply hold the crate in place during loading.

The position and spacing of the bracing blocks may be altered to ensure proper engagement with the rim of a crate while ensuring that any arrangement of product containers being loaded into the crate avoid being interfered with by a given bracing block.

Each bracing block comprises a finger with an angled surface which acts to draw in and engage one of the four sides of a crate when a crate is pushed against the angled surface. The shape and arrangement of each bracing block ensures that a crate is centered and fully opened so that it may receive product containers from a loading mechanism in the same manner as a crate that does not have any warped side or sides.

In at least one embodiment the bracing blocks are covered by one or more flap guides which aid in guiding product containers into the crate.

DETAILED DESCRIPTION

Figure 1:
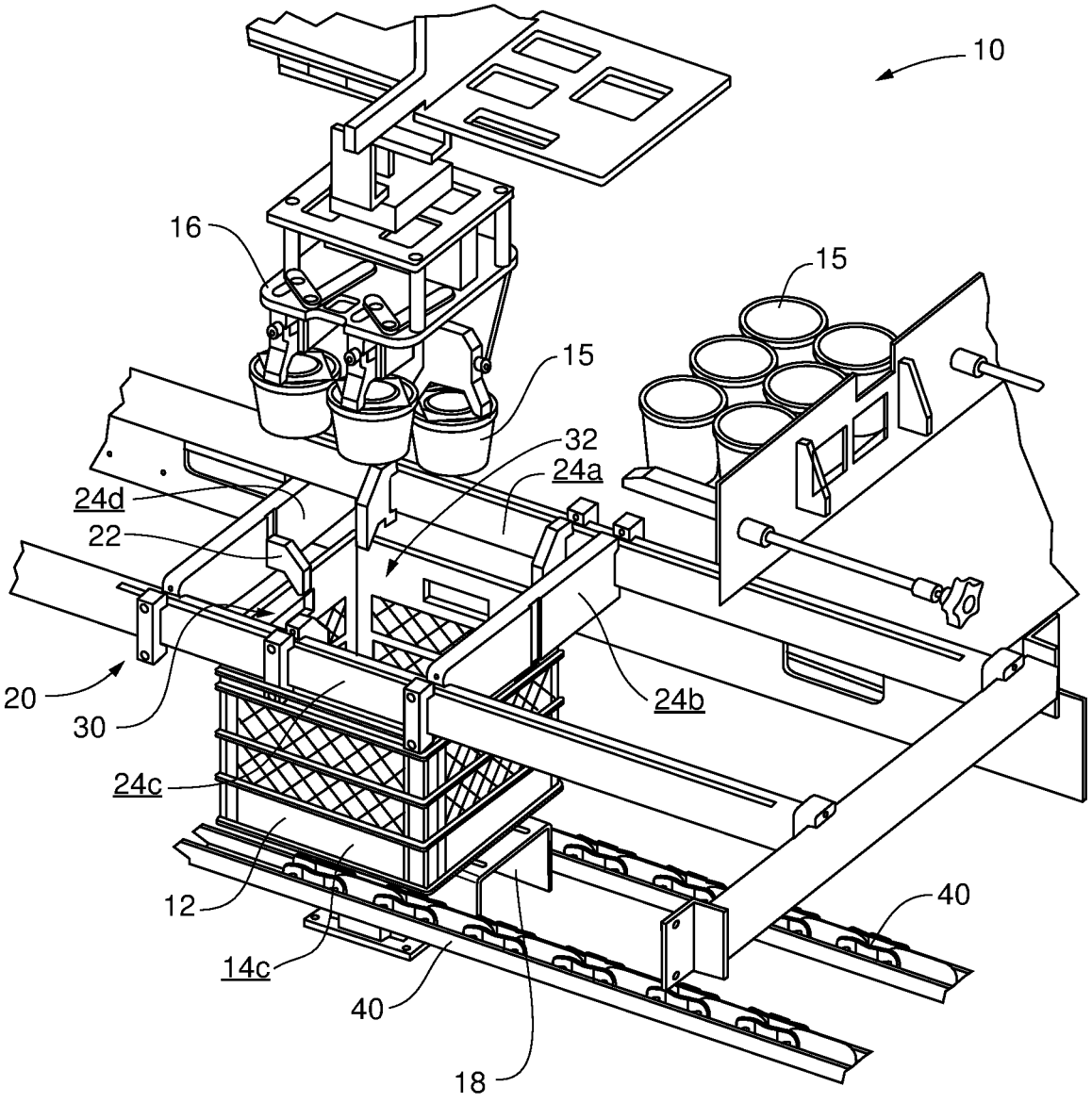
FIG. 1 is a perspective view of a loading system including a crate bracing assembly, depicted engaging a crate during the loading process.

An embodiment of the present disclosure is shown in FIG. 1 and comprises a crate loading system 10 for loading a reusable crate 12 with one or more product containers 15 via a transfer or pick-up head 16.

The crate loading system 10 includes a crate actuation or lift assembly 18 and a bracing assembly 20. During operation of the system 10, a crate 12 is actuated such as by being lifting or pushed upward toward the bracing assembly by the lift assembly 18. In some embodiments advancement of the crate 12 along the conveyor is simply paused and it is the bracing assembly 20 which is actuated in a downward direction to engage the crate 12.

The bracing assembly 20 includes at least one bracing block 22 mounted to each of four sides or bracing members 24*a*, 24*b*, 24*c* and 24*d* of the bracing assembly 20. When the actuation assembly 18 pushes the crate upward toward the bracing assembly 20, or otherwise brings the crate 12 and bracing assembly 20 into engagement, each side 14*a*, 14*b*, 14*c* and 14*d* of the crate 12 is engaged by the block or blocks 22 mounted on the correspondingly positioned member 24*a*, 24*b*, 24*c* or 24*d* of the bracing assembly at substantially the same time or simultaneously.

In some embodiments, only one set of opposing sides 14*a* and 14*c*, or 14*b* and 14*d*, are distorted and require straightening or bracing. In such an embodiment only the correspondingly sides the bracing assembly 20 that correspond to the distorted opposite side of the crate require bracing blocks 22 for use in straightening or bracing this single pair of opposing sides 14*a* and 14*c* or 14*b* and 14*d* of the crate 12. In such an embodiment only the corresponding parallel and opposite members 24*a* and 24*c* or 24*b* and 24*d* need be provided with bracing blocks 22.

Engagement of the sides 14*a*, 14*b*, 14*c* and 14*d* of the crate 12 by the bracing blocks 22 acts to ensure that the crate opening 30 is of a uniform and set dimension akin to that of a crate with no distortion (an opening of normal or nominal size and shape), and that this opening 30 as defined by the sides 14*a*, 14*b*, 14*c* and 14*d* of the crate 12 is centered within the bracing assembly 20 as defined by bracing members 24*a*, 24*b*, 24*c* or 24*d*. Once in this position, the pick-up head 16 will descend toward the crate opening 30, and deposit the product container or containers 15 into the crate interior 32.

Figure 2A:
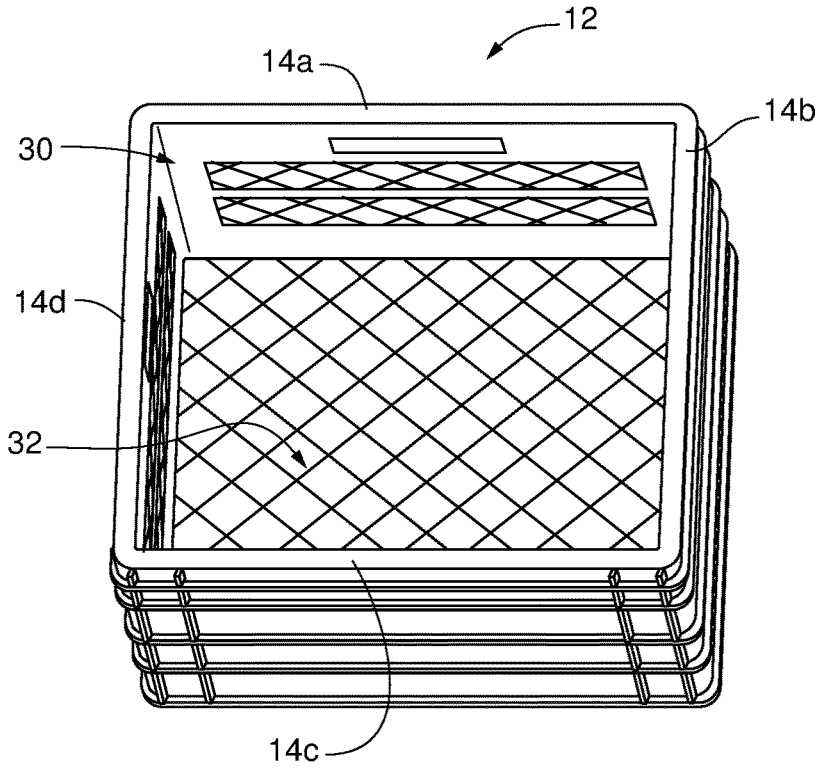
FIGS. 2*a* and 2*b* are top down, perspective views of crates useable in the system of claim 1, a crate is shown both in a normal un-warpped configuration (FIG. 2*a*) and wherein the sides of the crate have become warpped or bowed (FIG. 2*b*).
Figure 2B:
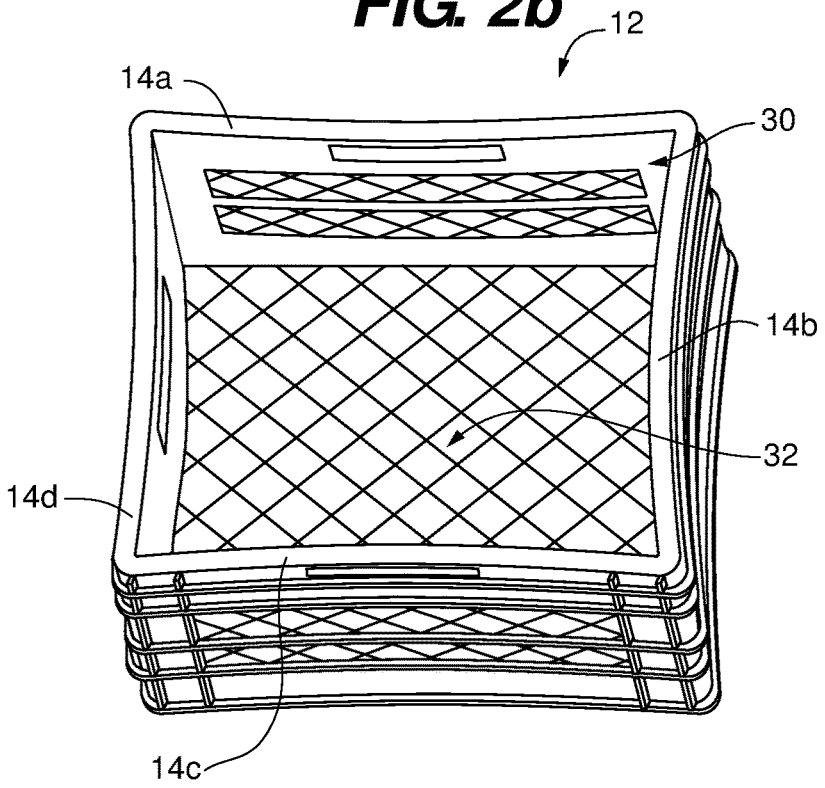

The bracing assembly 20 is configured to engage a crate 12 which has sides 14*a*, 14*b*, 14*c* and 14*d* that are uniformly sized and spaced to form the consistent form and shape of the opening 30 that such crates are known to provide. An example of such an ideally shaped crate 12 is shown in FIG. 2*a*. The bracing assembly 20 of the embodiment shown in FIG. 1 may also, however, be used with crates 12 that have one or more sides 14*a*, 14*b*, 14*c* and 14*d* that are bent, bowed or otherwise distorted such as in the manner shown in FIG. 2*b*.

Such distortion of the crate's sides often occurs over time and multiple reuse of the crate. In many if not all prior art loading systems, a crate 12 having an inconsistently dimensioned or shaped opening 30, such as that shown in FIG. 2*b*, will not properly interact with the pick-up head and/or the assemblage of product containers that the loading system is attempting to load into the crate 12, as one or more of the bowed sides of the crate will contact and interfere with the containers being loaded or the pick-up head as they descend toward the crate during the loading process. The bracing assembly 20 and its use of bracing blocks 22 allows the present system 10, such as is shown in FIG. 1, to continue using crates having uniform openings (see FIG. 2*a*) as well as crates having distorted openings (see FIG. 2*b*) by ensuring that the sides of the crate always define a uniformly shaped opening 30 for the crate 12 during the loading process.

Figure 3A:
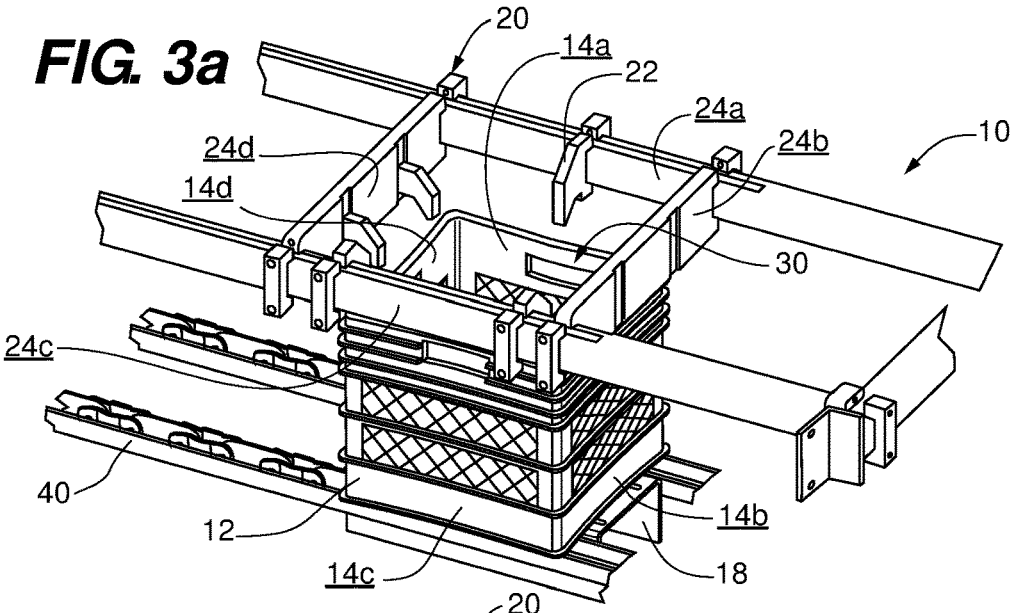
FIGS. 3*a*-3*c* are a sequence of perspective views of a crate and bracing assembly, showing the manner in which a crate is pushed upward by the system to engage the bracing assembly, in the manner shown in FIG. 1.
Figure 3B:
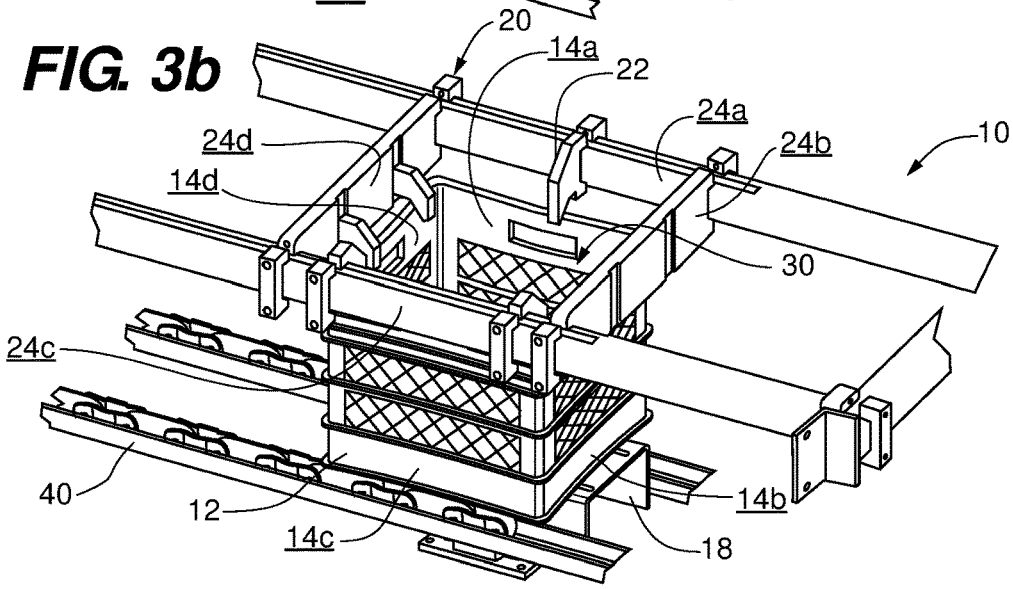
Figure 3C:
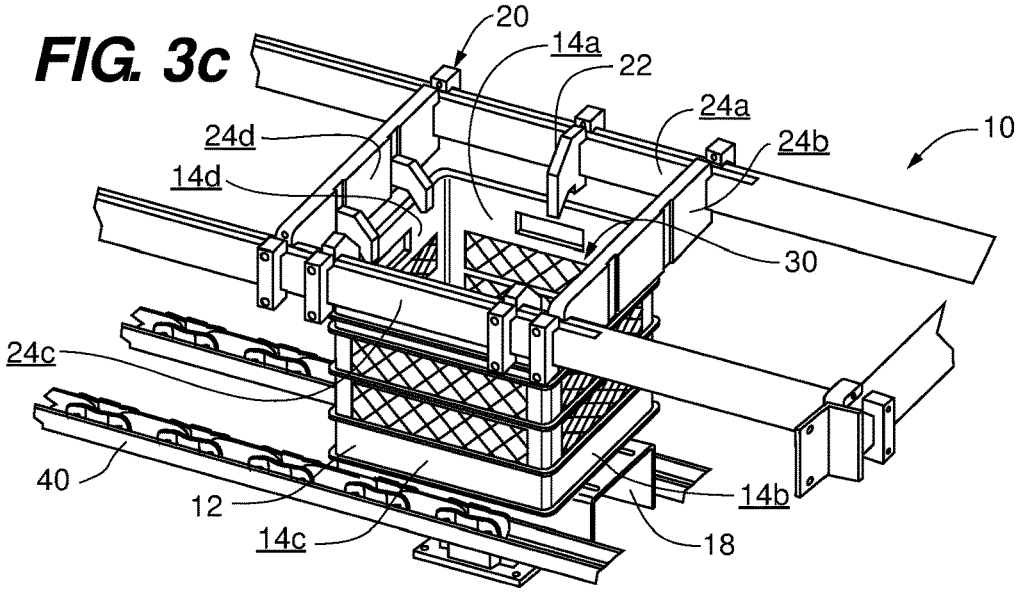

As shown in FIGS. 3*a*-3*c*, in practice, the crate 12—having a uniform or distorted opening shape—is advanced along a conveyor 40 or other mechanism until it is positioned beneath the bracing assembly 20. Within or beneath the conveyor is the crate lift assembly 18. When the crate 12 is properly in position beneath the bracing assembly 20, the crate lift assembly 18 is actuated and subsequently lifts the crate 12 upward from the conveyor 40 and toward the bracing blocks 22 of the bracing assembly 20. As the crate 12 is lifted upward by the crate lift assembly 18, each of the bracing blocks 22 contact, and by way of their unique shape and engagement to the rigid bracing members 24*a*, 24*b*, 24*c* or 24*d*, pull, push or otherwise act upon the respective sides 14*a*, 14*b*, 14*c* and 14*d* of the crate 12 so as to position the sides to define an opening 30 of a uniform dimension akin to that of a crate 12 whose sides have no distortions, such as that shown in FIG. 2*a*.

Figure 4B:
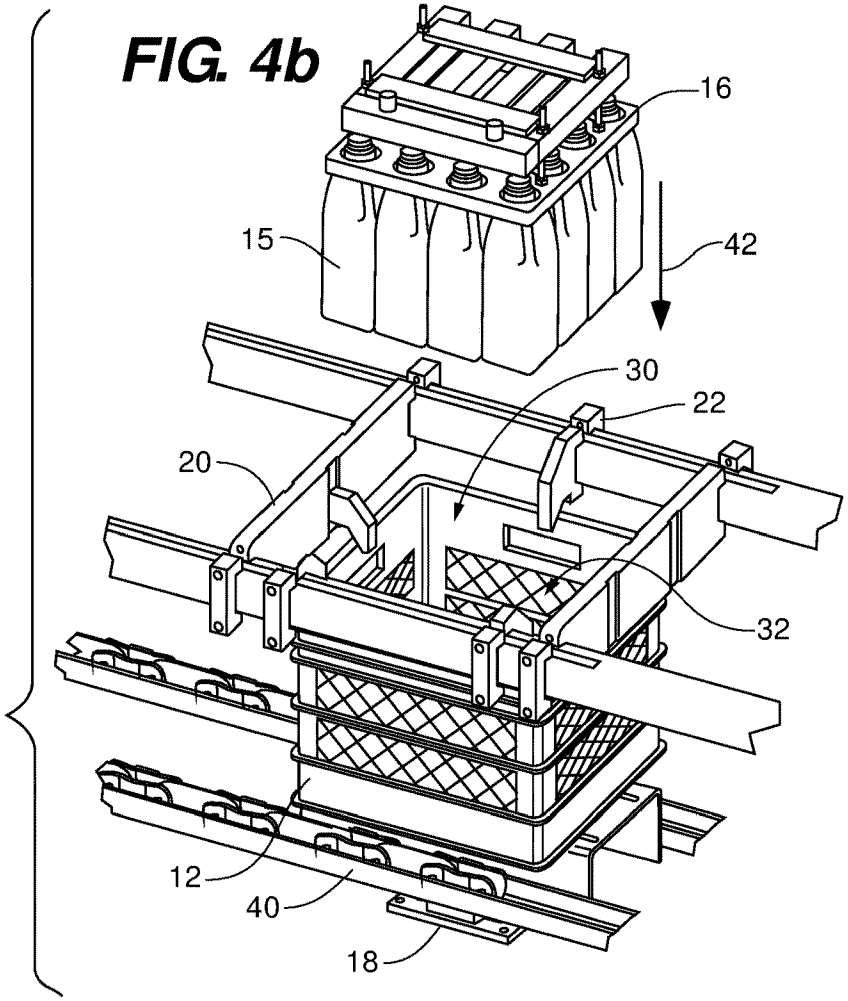
FIGS. 4*a* and 4*b* depict the manner in which the system forces the crate upward to engage the bracing assembly before the crate is loaded with product containers via a loading head.
Figure 4A:
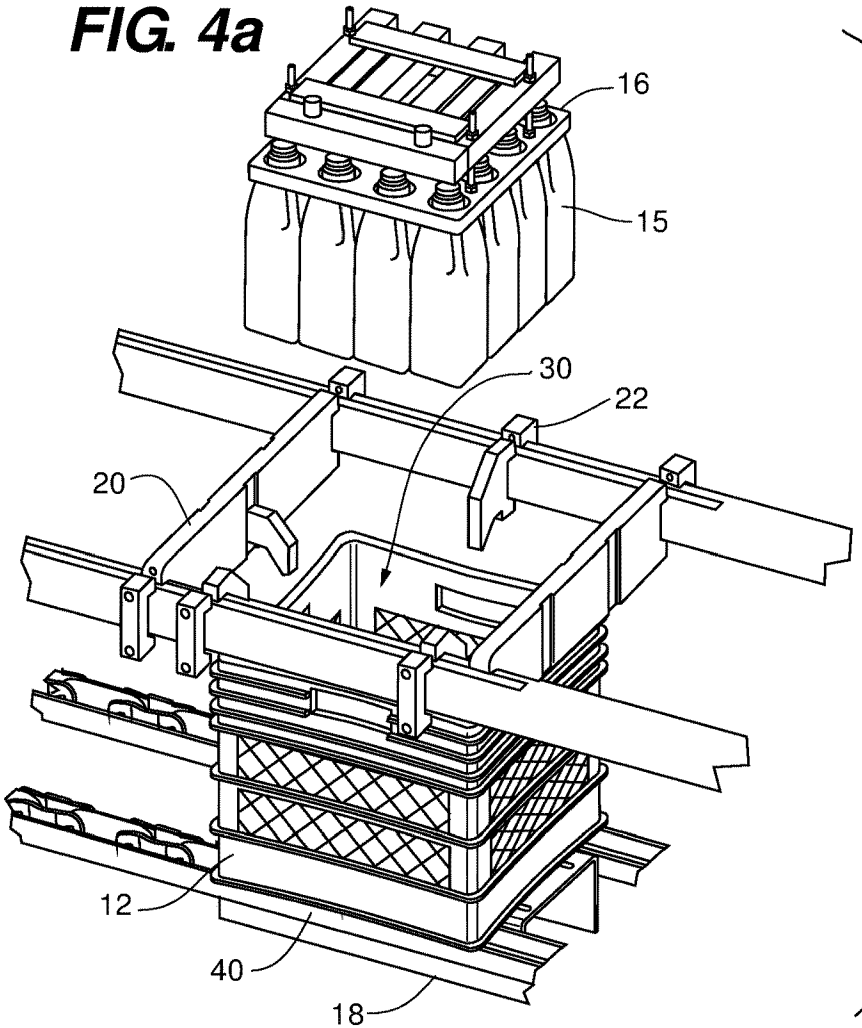

As illustrated in FIGS. 4*a* and 4*b*, once the crate 12 is properly lifted into position within the bracing assembly 20 by the crate 12 lift assembly 18, and the sides of the crate 12 are engaged by the bracing blocks 22, to ensure that the crate opening 30 has a properly uniform opening size and shape; the system 10 will trigger the pick-up head 16 to descend toward the crate 12 (see arrow 42) and place and its assemblage of product containers 15 into the crate interior 32.

The manner in which each block 22 engages a side 14 of the crate 12 is depicted in detail in FIGS. 5*a*-5*d*. In the embodiment shown, a bracing block 22 is shown as being comprised of a finger-like protrusion of metal or other rigid material such as steel, aluminum, hardened plastic, etc. Each bracing block 22 is engaged to and extends from one of the bracing members 24 (24*a*, 24*b*, 24*c* and 24*d*) such as in the manner shown in FIGS. 1, 3*a*-3*c* and 4*a*-4*b*.

Returning to FIGS. 5*a*-5*d*, it is shown that each bracing block 22 has a V-shaped grasping portion 44 of which a one side of the grasping portion 44 has an outside surface 46 that is substantially parallel to the vertical surfaces 48 of the crate 12. A second side of the grasping portion 44 defines an interior surface 50 that engages the side 14 of the crate 12 as the crate is lifted upward (as indicated by arrow 52 toward the bracing assembly in the manner shown in FIGS. 3*a*-3*c* and 4*a*-4*b*.

In at least one embodiment the vertically oriented outside surface 46 forms an angle $\alpha$ of about 45 degrees with the interior surface 50 that engages the crate 12. In some embodiments angle $\alpha$ is between 35 and 55 degrees. The angle of the interior surface and exterior surface is selected to minimize the chance that the crate 12 will jam or become stuck by the bracing blocks 22 while providing a slope to the interior surface 50 that is sufficient to bias a given side 14 of the crate 12, that may have been distorted (such as in the manner shown in FIG. 2*b*), into a shape and alignment of that of a non-distorted crate 12. Line or plane 54 provided in FIGS. 5*a*-5*d* represents the idealized, non-distorted alignment goal that the bracing assembly seeks to position the inside surface 48 of the side 14 into.

As is shown in the sequence of FIGS. 5*a*-5*d*, as the crate 12 is pushed upward toward the bracing assembly (see FIGS. 4*a*-4*b*) the interior surface 50 of the bracing block extends horizontally over the inside vertical surface 48 of the side 14. This will be true whether or not the side 14 in question is distorted (or not) relative to the otherwise nominal or ideal position, as represented by plane 54, of a crate side 14. A given side 14 of the crate 12 may vary in position (i.e. be distorted) as measured by the inside vertical surface 48 by as much as a half of an inch (i.e. +/−12 mm-13 mm) inward or outward from the nominal position 54. In at least one embodiment, the amount of variance from nominal that a side 14 of the crate 12 may exhibit and still be used by the system 10 (see FIG. 1) and engaged by the bracing block 22 may be up to an inch in either direction (i.e. +/−24 mm-26 mm) of the nominal position 54.

Figure 5B:
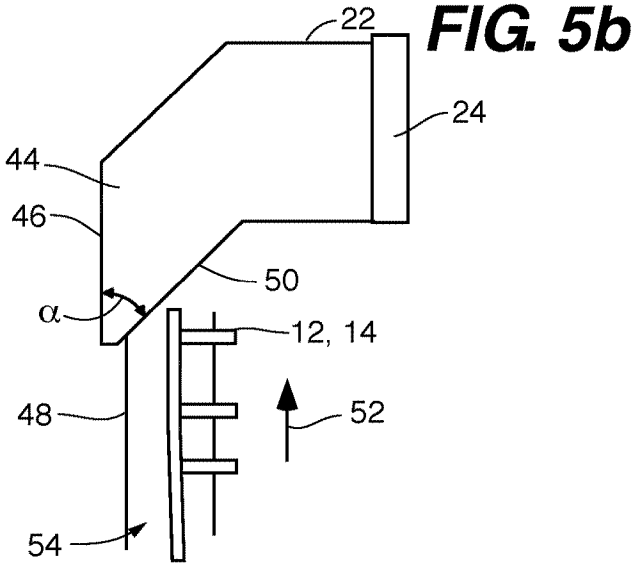
FIGS. 5*a*-5*d* are a sequence of close up, side view images showing the manner in which a bracing block engages a side of a crate as the crate is pushed upward against the bracing blocks in accordance with the loading method and system shown in FIG. 1 and sequence shown in FIGS. 3*a*-3*c*, 4*a* and 4*b*.
Figure 5D:
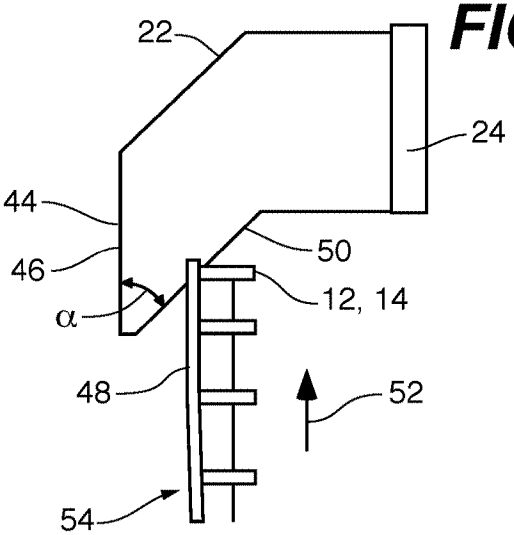
Figure 5A:
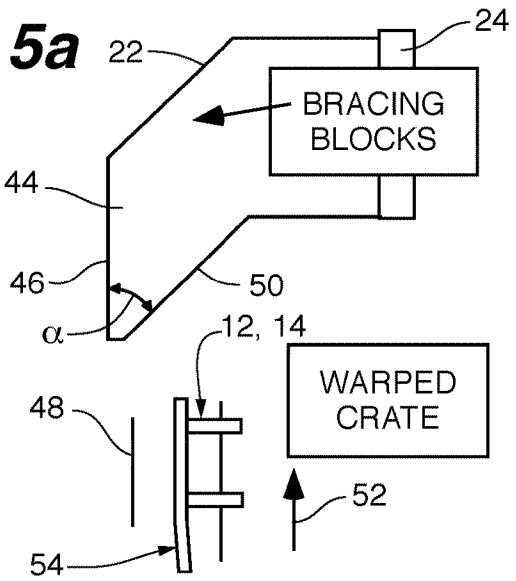
Figure 5C:
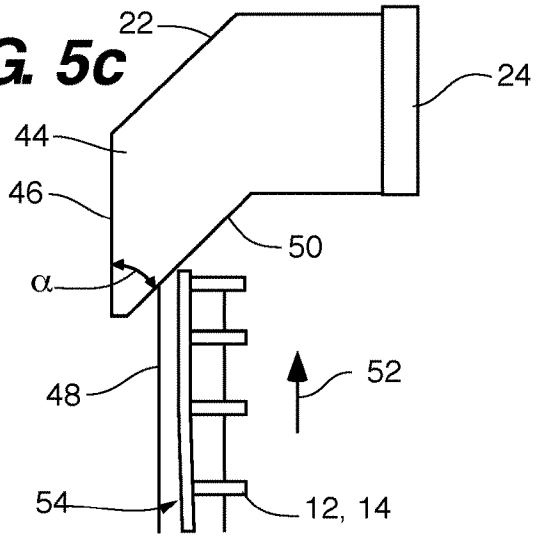

As the side 14 of the crate 12 continues its upward push (see arrow 52) against the bracing block 22, such as is shown in FIGS. 5*b*-5*d*, the more flexible structure of the side 14 is pulled and biased against and along the interior surface 50 of the bracing block 22. The length of the interior surface in combination with the steepness of the angle $\alpha$ determine the extent that the side 14 is repositioned.

Figure 6A:
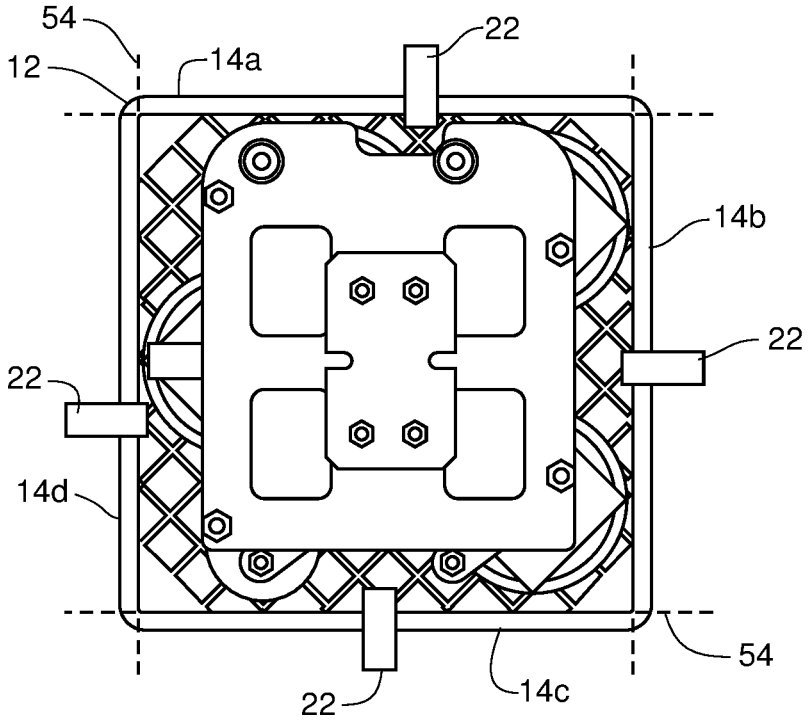
FIGS. 6*a* and 6*b* are a top down views of a loading head and array of product containers positioned within the crates of FIGS. 2*a* and 2*b* such as may occur during the loading of the crate, with the crate engaged by the bracing assembly (FIG. 6*a*) and after the crate is disengaged from the bracing assembly (FIG. 6*b*).
Figure 6B:
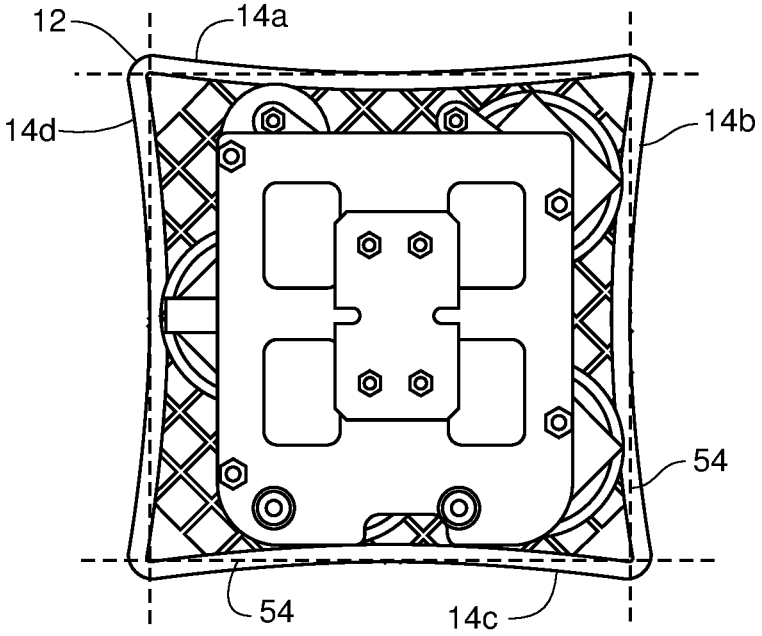

By having bracing blocks 22 positioned on opposing sides 14*a* and 14*c*, and/or 14*b* and 14*d* of the crate 12 such as in the manner shown in FIG. 6*a*, the opposing sides are effectively "pulled back" into their nominal or un-distorted position (represented by dotted lines 54) from their potentially distorted position such as is illustrated in FIG. 6*b*. When fully biased against the inside surface 50 of the bracing blocks 22, such as in the manner shown in FIG. 5*d*, the inside surface 48 of the opposing sides 14*a* and 14*c*, and/or 14*b* and 14*d* of the crate 12 are substantially parallel to each other and collectively define the nominal opening size and shape of an undistorted crate 12 regardless of the distortion (within the range described above) that any or all of the sides 14*a*, 14*b*, 14*c* or 14*d* might normally exhibit before their engagement with the bracing assembly.

As has been mentioned above, it is an essential feature of the system 10 shown in FIG. 1 to allow distorted and undistorted crates 12 alike, to be loaded with product containers 15 without the loading process becoming fouled by unintended contact between the containers 15 or pick-up head 16 with the sides of the crate 12 being loaded. As has been described thus far, system 10 provides for this feature through the use of the bracing assembly 20, and more particularly the simultaneous action of lifting the sides 14*a*, 14*b*, 14*c* and 14*d* against bracing blocks 22 so as to reconfigure the crate opening 30 to be substantially the same to that of an undistorted crate.

A potential consequence of positioning bracing blocks 22 against and over the sides 14*a*, 14*b*, 14*c* and 14*d* of a crate 12 during the loading process is that the blocks 22 may themselves interfere with the assemblage of product containers 15 being deposited in the crate by the pickup head 16 while the crate 12 is held in place by the biasing assembly 20 of the system 10.

Embodiments of the system 10 anticipate this potential problem and provide for the bracing blocks 22 to be readily removable and repositionable anywhere along each of the bracing members 24*a*, 24*b*, 24*c* and 24*d*, so that the bracing blocks may be positioned in such a manner to ensure that any shape, size, contour, etc. of the product containers 15 being deposited into the crate 12 are not interfered with by either the sides 14*a*, 14*b*, 14*c* and 14*d* of the crate 12 nor the bracing blocks 22.

Figure 7:
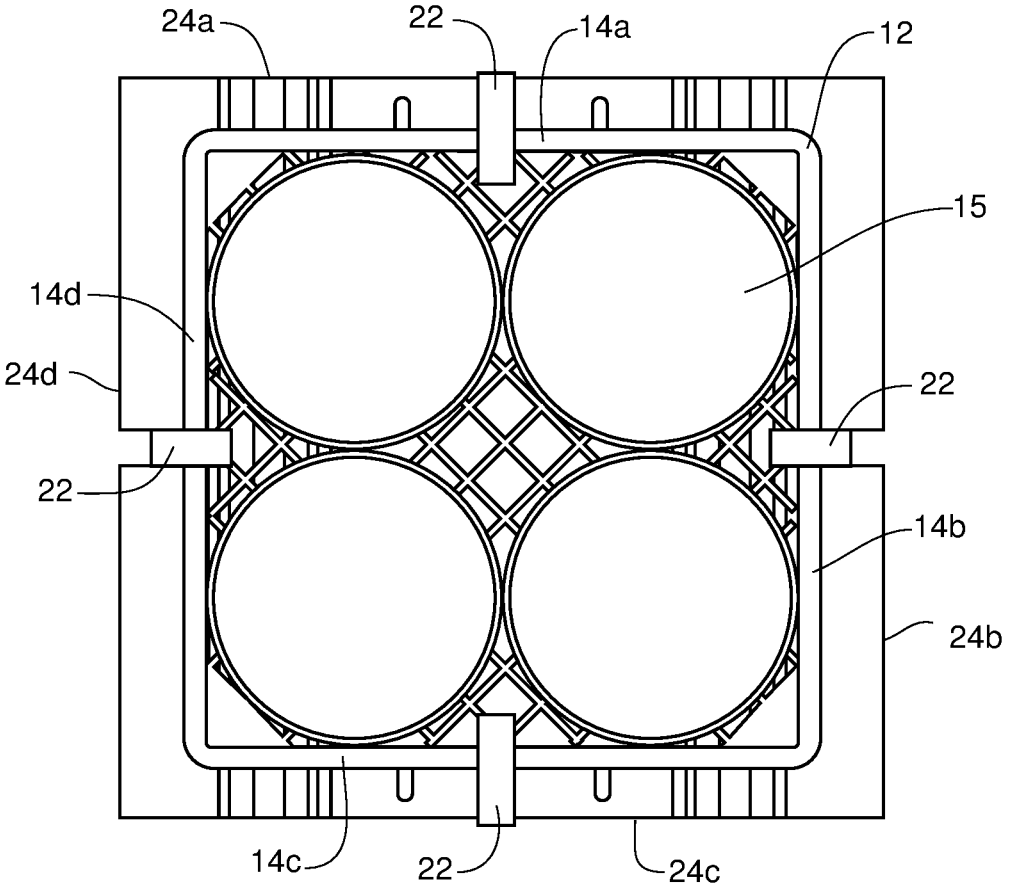
FIG. 7 is a top down view of a crate engaged by the bracing assembly and with product containers present in the crate, and illustrating the manner in which the bracing blocks may be arranged along the side of the crate to avoid contact with the product containers.

An example illustration of this capability is provided in FIG. 7 wherein bracing blocks 22 are shown to have been prepositioned along bracing members 24*a*, 24*b*, 24*c* and 24*d* to ensure that the product containers 15 have sufficient space and clearance to avoid contact with the blocks 22 during the loading process.

Figure 8:
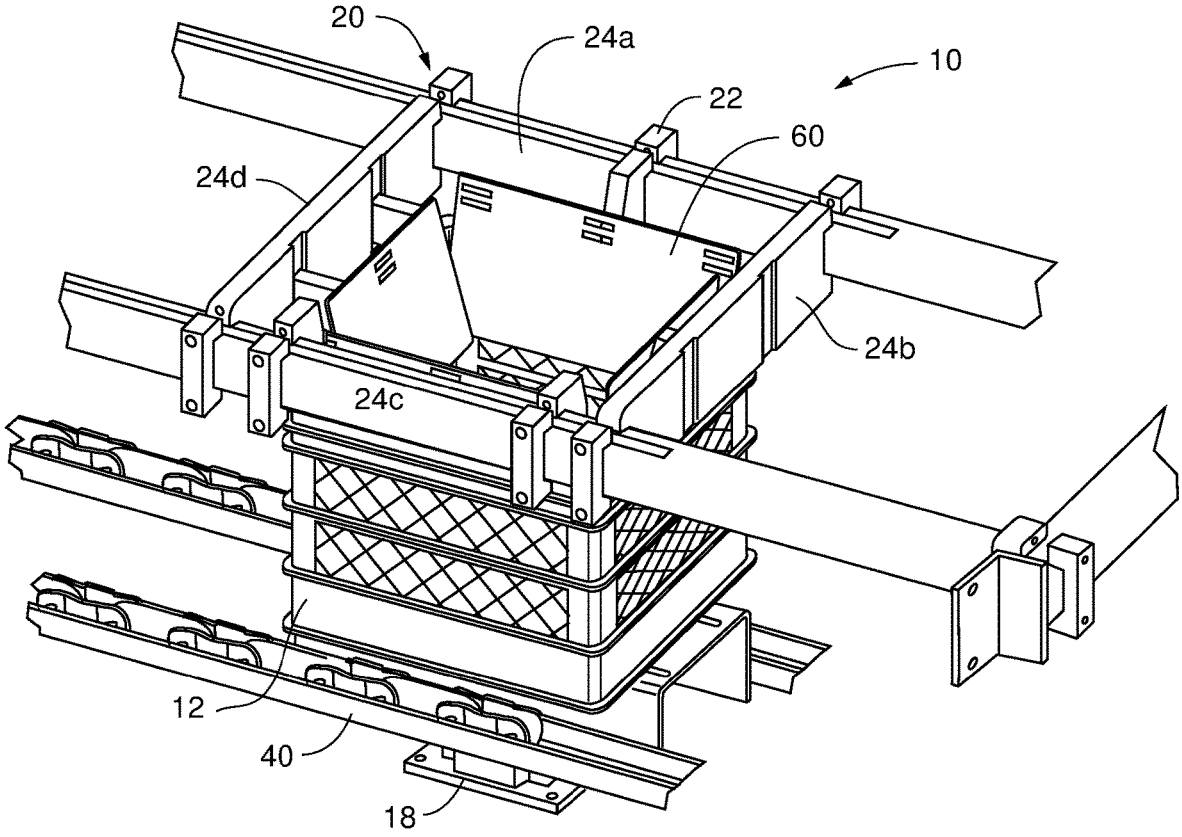
FIG. 8 is a perspective view of the crate and bracing assembly shown in FIG. 1 with flap guides in place to ensure no contact between the bracing blocks and product containers.

In some embodiments, an example of which is shown in FIG. 8, the system 10 includes flap guides 60 as part of the bracing assembly 20. These flap guides at least partially cover the bracing members 24*a*, 24*b*, 24*c* and 24*d* and associated bracing blocks 22, and also act as a funnel or guide for product containers being deposited into the crate 12 during the bracing and loading process described above. Flap guides 60 may be plates or sheets of material that are bolted, fastened, mechanically engaged or otherwise attached to the blocks 22 and/or bracing members 24*a*, 24*b*, 24*c* and 24*d*.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A system for loading product containers into a crate wherein the crate is a reusable crate having four sides, the system comprising:

a crate, the inside surface of the four sides of the crate define a distorted crate opening size and shape wherein at least one set of opposing sides of the crate are not substantially parallel to one another;

a conveyer, the conveyer constructed and arranged to convey the crate to an actuation assembly;

the actuation assembly constructed and arranged to actuate the crate into biased engagement with a bracing assembly;

the bracing assembly comprising:

four bracing members, a first pair of the four bracing members being positioned in parallel opposition to one another, each of the first pair of bracing members having at least one bracing block engaged thereto, each bracing block having a grasping portion, the grasping portion having an outside surface and an inside surface, the inside surface constructed and arranged to be in contact with one of the four sides of the crate when the crate is actuated into biased engagement with the bracing assembly;

the bracing blocks are arranged to define a nominal crate opening size and shape wherein opposing sides of the crate are substantially parallel to one another, the inside surface of the four sides of the crate also define the nominal crate opening size and shape after the crate has been actuated by the actuation assembly into biased engagement with the bracing assembly.

2. The system of claim 1, wherein the four bracing members include a second pair of bracing members, each of the second pair of bracing members having at least one second bracing block engaged thereto, each second bracing block having a second grasping portion, the second grasping portion having a second outside surface and a second inside surface, the second inside surface constructed and arranged to be in contact with one of the four sides of the crate when the crate is actuated into engagement with and biased against the bracing assembly.

3. The system of claim 2, wherein the inside surface and the outside surface of the grasping portion form an angle of about 35 to about 55 degrees.

4. The system of claim 2, wherein the inside surface and the outside surface of the grasping portion form an angle of about 45 degrees.

5. The system of claim 2, wherein the outside surface of the grasping portion is substantially parallel with an inside surface of the one of the four sides of the crate after the crate has been actuated into biased engagement with the bracing assembly.

6. The system of claim 2, further comprising a pick-up head, the pick-up head constructed and arranged to pick-up at least one product container and deposit the at least one product container into the crate after the crate has been biased against the bracing assembly and the inside surface of the four sides of the crate define the nominal crate opening size and shape.

7. The system of claim 6, wherein the bracing blocks are positioned such that the at least one product container does not contact any of the bracing blocks when the pick-up head deposits the at least one product container into the crate.

8. The system of claim 2, wherein each of the bracing blocks define a nominal plane representative of the position of a crate side which defines the nominal crate opening size and shape, each of the four sides of the distorted crate opening are no more than one inch offset from the nominal plane prior to being actuated into biased engagement with into the bracing assembly.

* * * * *